United States Patent [19]

Matlach et al.

[11] Patent Number: 4,570,656

[45] Date of Patent: Feb. 18, 1986

[54] METHOD OF TRANSPORTING VISCOUS HYDROCARBONS

[75] Inventors: William J. Matlach, St. Louis; Michael E. Newberry, Chesterfield; Charles L. Thierheimer, Jr., St. Louis, all of Mo.

[73] Assignee: Petrolite Corporation, St. Louis, Mo.

[21] Appl. No.: 491,821

[22] Filed: May 5, 1983

[51] Int. Cl.[4] ..... F17D 1/17

[52] U.S. Cl. ..... 137/13; 252/8.55 R

[58] Field of Search ..... 137/13; 252/8.3, 8.5 P, 252/8.55 R

[56] References Cited

U.S. PATENT DOCUMENTS

| | | | |
|---|---|---|---|
| 3,150,085 | 9/1964 | Mallory | 252/8.5 |
| 3,380,531 | 4/1968 | McAuliffe et al. | 137/13 X |
| 3,491,835 | 1/1970 | Gagle | 137/13 X |
| 3,519,006 | 7/1970 | Simon et al. | 137/13 |
| 3,528,914 | 9/1970 | Darley | 252/8.5 |
| 3,552,494 | 1/1971 | Kiel | 252/8.55 |
| 4,099,537 | 7/1978 | Kalfoglou et al. | 252/8.55 X |
| 4,246,919 | 1/1981 | McClaflin | 137/13 |
| 4,265,264 | 5/1981 | Sifferman | 252/8.55 |
| 4,287,902 | 9/1981 | McClaflin et al. | 252/8.55 X |
| 4,420,008 | 12/1983 | Shu | 137/13 X |

*Primary Examiner*—Herbert B. Guynn
*Attorney, Agent, or Firm*—Robert E. Wexler

[57] ABSTRACT

An improved method of transporting viscous hydrocarbons containing at least 10 to 15 percent water from a well bore hole or between two points via pipeline which comprises adding to the viscous hydrocarbon containing water a sufficient amount of a nonaqueous solution or dispersion of a surfactant to form a low viscosity oil-in-water emulsion which is easily transported.

32 Claims, No Drawings

METHOD OF TRANSPORTING VISCOUS HYDROCARBONS

BACKGROUND OF THE INVENTION

1. Field of the Invention

This invention relates to an improved method of transporting viscous hydrocarbons, such as crude oil, from a well or between two points via pipeline.

In particular, the present invention relates to an improved method for increasing the pumpability and transportability of viscous hydrocarbons containing at least 10–15% water by adding thereto an effective amount of a solution or dispersion of a surfactant in a nonaqueous solvent therefor.

2. Description of Prior Art

The transportation of low gravity crudes throughout the entire production system from bore hole to the surface and then via pipeline to refinery is very difficult due to their high viscosity and resultant low mobility.

Three methods are currently used for increasing the pumpability and the transportability of viscous hydrocarbons, such as heavy crudes.

One method utilized to assist the flow of viscous hydrocarbons in pipelines is the installation of heating equipment downhole and/or at frequent intervals along the pipeline, whereby the crude is heated to reduce its viscosity and thereby facilitate its transport. Heaters employed for this purpose can be operated by withdrawing some of the crude being transported for use as fuel. This procedure, however, is costly to install and maintain and may result in the loss of as much as 15 to 20% of the crude being transported.

Another method used to reduce the viscosity of heavy crudes and increase their pumpability and transportability is the introduction of a low viscosity hydrocarbon diluent, e.g., light oil, kerosene distillates or the like into the well bore or pipeline to dilute or thin the viscous hydrocarbon crude.

Both of the above methods have become quite expensive as the cost of energy and dilution stocks has risen dramatically.

A third method for increasing the pumpability and transportability of viscous hydrocarbons is the addition thereto of an aqueous solution of a surfactant which forms a low viscosity oil-in-water emulsion. This method has proved effective in a number of instances. For example, U.S. Pat. No. 3,380,531 and U.S. Pat. No. 3,467,195 teach the improvement of viscosity by the addition of an aqueous solution of a nonionic surfactant. Similarly, prior patents disclose the use of high salt content emulsion (U.S. Pat. Nos. 3,487,844, 3,943,954, 4,099,537 and 4,108,193), the use of low water cuts (U.S. Pat. Nos. 3,425,429 and 3,519,006) and blends of surfactants (U.S. Pat. Nos. 4,239,052, 4,246,919, 4,249,554 and 4,265,264).

BRIEF SUMMARY OF THE INVENTION

The present invention provides an improved method for enhancing the pumpability and transportability of viscous hydrocarbons, such as heavy crudes, containing at least 10–15% water by adding to said viscous hydrocarbon an effective amount of an emulsion-forming solution or dispersion of a surfactant in a nonaqueous solvent therefor.

Addition of the solution or dispersion of surfactant in a nonaqueous solvent to the viscous hydrocarbon containing water forms a low viscosity oil-in-water emulsion, thus enhancing the ease of pumpability and transportability of the viscous hydrocarbon. If the viscous crude oil does not already contain sufficient water, any available water (pure or containing high amounts of dissolved solids) may be added.

DETAILED DESCRIPTION OF THE INVENTION

As described above, the present invention relates to an improved method of increasing the ease of pumpability and transportability of viscous hydrocarbons from bore holes and in pipelines. The improvement of the present invention comprises the addition, to a viscous crude oil containing at least 10 to 15% water (either naturally present or added water), of a solution of a surfactant in a nonaqueous solvent therefor, causing the formation of a low viscosity oil-in-water emulsion.

It has now been found that by modifying the surfactant structure and by selecting an appropriate combination of solvents, the surfactant may be added to the viscous hydrocarbon crude oil in a nonaqueous form (solution or dispersion). Surprisingly, this modified surfactant, added in a nonaqueous solution or dispersion, effectively forms a low viscosity oil-in-water emulsion, greatly simplifies the surfactant addition procedure and improves the final quality of the viscous crude oil by providing an oil-in-water emulsion which separates more easily when heated and which has less hydrocarbon carryover into the separated water. Insofar as is known, this method applies to any viscous crude.

In accordance with this invention it has been found that, since many viscous crudes contain at least a small amount of water, i.e., from at least about 10 to about 15%, it is not always necessary to add an aqueous solution of surfactant thereto as has been heretofore practiced. Thus, the present invention eliminates the necessity of transporting an aqueous solution of surfactant via truck to the field for injection at the site and further eliminates the necessity of separating large amounts of water from the resultant emulsion of the viscous crude.

Further, since the present invention contemplates the addition of a concentrated solution or dispersion of a surfactant in a nonaqueous solvent therefor, the solution may be added to the viscous crude containing at least 10–15% water by addition to the light oil diluent stream which is frequently added to the viscous crude at the field site for the purpose of diluting same. It is not possible to add the presently used aqueous solution of surfactants in this manner since the aqueous solution is not miscible in the light oil.

Accordingly, it is only necessary, in accordance with the present invention, that the concentrated nonaqueous solution of surfactant be transported to the field where it is added directly to the light hydrocarbon stream used to dilute the viscous crude in the bore hole or pipeline. Thus, by virtue of the present invention, there is provided a one stream addition to viscous crude systems containing at least 10–15% water.

Hydrocarbon diluents which are presently added to viscous crudes in order to facilitate transport thereof include light oils such as kerosene distillate and high gravity crude oils such as condensates. Generally, at least some hydrocarbon diluent is added to the viscous crude in order to conform to pipeline requirements for minimum API gravities. The gravity specification is normally set in the range of 11 or 12 API units, thus requiring the addition of a hydrocarbon diluent to a field crude averaging below 11 or 12 API units. Because of the cost and limited availability of hydrocarbon diluents, costs are minimized if only the minimum required quantity of diluent is added to meet the API gravity specifications. Overuse of the diluent typically occurs when larger quantities are used to dilute the viscous crude to increase the ease of pumpability and transportability thereof.

The present invention therefor contemplates the addition of a concentrated solution or dispersion of surfactant in a nonaqueous solvent therefor to the kerosene distillate or other hydrocarbon diluent used to meet minimum API gravities.

If the viscous crude does not contain the minimum 10–15% water necessary to form an emulsion upon contact with the surfactant, water may be added by any means available to afford the 10–15% minimum level. Importantly, however, the amount of water which may be needed in the method of the present invention is not tied to the amount of surfactant used as in prior methods.

The amount of light hydrocarbon crude, such as kerosene distillate, which is added to the viscous hydrocarbon, will generally range from about 1 to about 20% by volume based upon the volume of viscous hydrocarbon.

The surfactants which are used in the improved process of the present invention may be any surfactant which is capable of dissolution or dispersion in a nonaqueous solvent and capable of forming an emulsion upon contact with the viscous hydrocarbon crude containing at least 10 to 15% water by weight.

Accordingly, anionic, cationic, and nonionic surfactants may be used in accordance with the present invention provided they meet the requirements set forth above as to solubility and emulsion capabilities. Thus, anionic surfactants which may be used in accordance with the present invention include sulfated oxyalkylated fatty alcohols, sulfated oxyalkylated phenols and alkylphenols, alkarylsulfonates and the like.

Cationic surfactants which may be used in accordance with the present invention include oxyalkylated primary, secondary and tertiary amines, oxyalkylated polyamines and oxyalkylated alkanolamines and quaternaries thereof and the like.

Nonionic surfactants which may be used in accordance with the present invention are those described in "Emulsion Theory and Practice", P. Becher, ACS Monograph, No. 162, 1965, Reinhold Publishers, New York. The nonionic surfactants which are preferably used in accordance with the present invention are oxyalkylates of alkylphenols and may be represented by the following structural formulas:

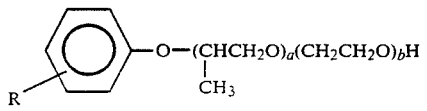

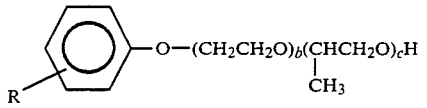

wherein R is an alkyl group containing from about 3 to about 24 carbon atoms, preferably from about 4 to about 15 carbon atoms, especially from about 8 to about 12 carbon atoms, a is a number of from 1 to about 40, preferably from about 2 to about 20, especially from about 3 to about 10, b is a number of from about 10 to about 100, preferably from about 30 to about 70, especially from about 40 to about 65, and c is in the range of from 1 to about 20, preferably from 1 to about 10, especially from about 1 to about 4.

Although the above-described nonionic surfactants have previously been considered only as aqueous solutions thereof, it has now been found that by a proper balance of propylene oxide and ethylene oxide units, and by a proper combination of nonaqueous solvents, such surfactants may be dissolved or dispersed in a nonaqueous solvent and still afford proper surfactant capabilities. The above-described nonaqueous surfactant solution or dispersion may be added directly to the viscous crude oil, may be dissolved in the hydrocarbon diluent which is added to the viscous crude oil, or may be dispersed in the hydrocarbon diluent which is added to the viscous crude oil.

It should be noted that other oxides (such as butylene oxide) may be substituted for propylene oxide.

Accordingly, it is important that, in the preparation of the preferred nonionic surfactants, the proper ratio of propylene oxide to ethylene oxide be used in order to afford a surfactant which is balanced in such a manner that its nonaqueous solvent characteristics are maximized while still retaining surfactant characteristics, i.e., that it contain the proper amount of propylene oxide moieties for maximum solubility in the nonaqueous solvent and the proper amount of ethylene oxide moieties to afford effective surfactant properties.

The oxyalkylated alkylphenols which are preferably used are prepared, in accordance with known methods, by reacting an alkylphenol with propylene oxide and ethylene oxide in proper proportions to afford the balanced surfactants described above. In general, the ratio of propylene oxide to ethylene oxide units in the molecule should be in the range of from about 1:1 to about 1:100, preferably from about 1:1 to about 1:50, especially from about 1:1 to about 1:20. It should be understood, however, that the type of oxyalkylation (i.e., whether ethylene oxide, propylene oxide, butylene oxide, etc.) and the proper ratio of such oxyalkylate units will vary, depending upon the material being oxyalkylated, the nonaqueous solvent system therefor and the hydrocarbon crude being treated. A modicum of experimentation may be necessary to determine the precise oxyalkylates and the ratio thereof to each other to afford the proper solubility and surfactant characteristics to emulsify a given crude.

Addition of propylene oxide improves the solubility of the surfactants in the hydrocarbon diluent. However, only enough propylene oxide is used to assure solubility or dispersibility of the surfactant in the hydrocarbon diluent. Sufficient ethylene oxide must be added to assure the emulsification ability of the surfactant. Adding propylene oxide first to the alkyl phenol followed by ethylene oxide is greatly preferred as this method most effectively enhances both hydrocarbon diluent solubility and emulsification ability of the surfactant. Adding ethylene oxide to the alkyl phenol first followed by propylene oxide also enhances the hydrocarbon diluent solubility of the surfactant but detracts from the emulsification ability of the surfactant, thereby requiring the use of additional ethylene oxide. In general, any reasonable surfactant structure may be used in this invention. For example, butylene oxide may replace propylene oxide while still satisfying the criteria of improving the hydrocarbon solubility of the surfactant.

The nonaqueous solvents which are used to dissolve or disperse the surfactants in order to maintain solubility or dispersability of the surfactant in the light hydrocarbon diluent are, in the case of oxyalkylated alkyl phenols, aromatic solvents such as toluene, xylene, ethyl benzene, trimethylbenzene or other substituted alkylbenzenes or alkylnaphthalenes and mixtures thereof; alkylphenols such as nonylphenol, dodecylphenol, octylphenol, amylphenol, butylphenol or other alkyl phenols or mixtures thereof; ortho, meta, or para cresols, cresylic acid, xylenols, and mixtures thereof or any other nonaqueous solvent which is highly soluble in the hydrocarbon diluent and compatible with the surfactant.

In the case of surfactants other than the preferred oxyalkylated alkyl phenols, the nonaqueous solvents which may be used are, in general, aromatic solvents such as those described above mixed with somewhat more polar solvents such as $C_1$–$C_{10}$ branched and straight chain alcohols, diols or polyols, $C_2$–$C_{10}$ branched and straight chain ethers or any other suitable solvent of equivalent functionality.

Generally, the surfactant/nonaqueous solvent solution comprises from 1% or less to about 40% surfactant and, correspondly, from about 60% to nearly 100% solvent. The solvent may be any one of the described solvents or mixtures thereof.

The above-described surfactant solution can be directly added to the viscous crude oil containing at least 10% to 15% water. Or, more commonly, the surfactant solution can be added to the hydrocarbon diluent which is added to the viscous crude oil. The amount of the solution of surfactant which is added to the diluent hydrocarbon will generally range from less than 1% to about 90% by volume, preferably from about 3% to about 50%, especially from about 5% to about 20%, based on the volume of the hydrocarbon diluent, e.g., kerosene distillate, which is introduced into the borehole or pipeline containing the viscous hydrocarbon crude oil to be treated.

The amount of surfactant which is added to the visous hydrocarbon is generally in an amount of from about 10 to about 10,000 ppm, preferably from about 10 to about 2,000 ppm, especially from about 10 ppm to about 1000 ppm based on volume of total produced fluids (crude oil plus water plus hydrocarbon diluent).

The following examples illustrate specific, nonlimiting embodiments of the invention, including the best mode of practice of the invention.

The following materials and procedures were used in the tests described in the examples given below:

Crude oil from the Cat Canyon Oilfield in Santa Maria, Calif. (stock oil, ready for sale).

Water consisting of a synthetic preparation to simulate well-produced water. Total solids content: 21,300 ppm.

Viscosities were determined using a Brookfield Model LUF Viscosimeter with a No. 2 spindle according to the following procedure:

A 65% crude oil/35% water mixture was used as a control and was prepared by preheating the mixture in an oven to about 70° C. and then transferring it to a preheated Waring blender. The mixture was stirred at medium speed until the sample was homogeneous (about 20 seconds). Stirring was then stopped, the temperature was recorded and the viscosity measured at RPM levels of 6, 12, 30, 60, 30, 12 and 6. During all viscosity measurements, the blender jar was kept in a constant temperature bath.

Viscosities were calculated by using a multiplication factor of 10, 5, 2, 1, 2, 5 and 10 for the respective speeds times the inside dial reading indicated on the viscosimeter. A time test was instituted to demonstrate the relative stabilities of the emulsions under static conditions. This consisted of initial readings followed by a steady state reading at 60 RPM after 2 minutes and finally another reading at 60 RPM after a static period of 2 minutes. Only the 60 RPM viscosity values are shown for comparative purposes.

EXAMPLE 1

A series of oxyalkylated nonylphenols were prepared by reacting various molar proportions of propylene oxide and ethylene oxide with nonylphenol. Nonaqueous solutions of the resulting surfactants were prepared by mixing 20% phenol oxyalkylate, 35.6% nonylphenol and 44.4% xylene. The surfactant solution (1 ml) was then added to 10 ml kerosene distillate and the solubility checked for 24 hours at room temperature (24° C.). The following results were obtained:

TABLE I

Oxyalkylated Nonylphenol Solubilities
(C = Completely Soluble, N = Not Completely Soluble)

| COMPOUND NO | NONYL PHENOL | MOLES PROPYLENE OXIDE | MOLES ETHYLENE OXIDE | MOLES PROPYLENE OXIDE | KEROSENE SOLUBILITY AFTER 24 HOURS |
|---|---|---|---|---|---|
| 1 | 1 | 7.6 | 40 | 0 | C |
| 2 | 1 | 3.8 | 40 | 0 | N |
| 3 | 1 | 1.9 | 40 | 0 | N |
| 4 | 1 | 0 | 40 | 1.9 | C |
| 5 | 1 | .95 | 40 | 0 | N |
| 6 | 1 | 0 | 40 | 0.95 | N |
| 7 | 1 | 0 | 40 | 0 | N |
| 8 | 1 | 7.6 | 30 | 0 | C |
| 9 | 1 | 3.8 | 30 | 0 | C |
| 10 | 1 | 1.0 | 30 | 0 | N |
| 11 | 1 | 0 | 30 | 1.9 | C |
| 12 | 1 | .95 | 30 | 0 | N |
| 13 | 1 | 0 | 30 | .95 | C |
| 14 | 1 | 0 | 30 | 0 | N |
| 15 | 1 | 7.6 | 20 | 0 | C |
| 16 | 1 | 3.8 | 20 | 0 | C |
| 17 | 1 | 1.0 | 20 | 0 | C |
| 18 | 1 | 0 | 20 | 1.9 | C |

TABLE I-continued

| Oxyalkylated Nonylphenol Solubilities (C = Completely Soluble, N = Not Completely Soluble) | | | | | |
|---|---|---|---|---|---|
| COMPOUND NO | NONYL PHENOL | MOLES PROPYLENE OXIDE | MOLES ETHYLENE OXIDE | MOLES PROPYLENE OXIDE | KEROSENE SOLUBILITY AFTER 24 HOURS |
| 19 | 1 | .95 | 20 | 0 | C |
| 20 | 1 | 0 | 20 | .95 | C |
| 21 | 1 | 0 | 20 | 0 | C |
| 22 | 1 | 30 | 50 | 0 | C |
| 23 | 1 | 0 | 50 | 30 | C |
| 24 | 1 | 7.6 | 50 | 0 | N |
| 25 | 1 | 0 | 50 | 1.9 | N |
| 26 | 1 | 0 | 50 | 0 | N |

NOTE:
The columns indicate the order of addition of alkylene oxides. For example, in Compound No. 1, 7.6 moles of propylene oxide were first reacted with 1 mole of nonyl phenol. Subsequently, 40 moles of ethylene oxide were reacted with the reaction product of the first step. No additional propylene oxide was added. Notice that, for comparision, some of the oxyalkylates had no propylene oxide, e.g., Compound No. 7. It can readily be seen from the table that the use of propylene oxide, before or after the ethylene oxide, enhances the kerosene solubility of the surfactant.

EXAMPLE 2

In this example, viscosity measurements were taken as described previously but with percentages of oil, water and kerosene as shown. Sample 1 is the control. Sample 2 illustrates the effect of adding a hydrocarbon diluent to an oil and water mixture, and Samples 3 and 4 show the results when the 20% oxyalkylate solutions described in Example 1 are added to the kerosene diluent which is then added to the viscous crude oil/water mixture.

EXAMPLE 3

The nonaqueous solution from Example 1 was modified to improve kerosene solubility of surfactants containing greater numbers of moles of ethylene oxide. Nonaqueous solutions were prepared by mixing 20% nonyl phenol oxyalkylate, 72% mixed alkyl phenols, and 8% xylene. All phenol oxyalkylates were totally soluble in this solvent system. Table III shows selected examples of compounds which were used to prepare solutions as described above.

TABLE II

| | | Viscosity Comparison (Values in Centipoise) | | | |
|---|---|---|---|---|---|
| SAMPLE NO. | COMPOSITION | TEMP. °C. | 60 RPM | 2 MIN. DYNAMIC 60 RPM | 2 MIN. WAIT THEN 60 RPM |
| 1 | Crude oil only | 67 | 327 | 271 | 290 |
| 2 | 63% crude, 34% water, 3% kerosene diluent | 67 | 242 | 211 | 230 |
| 3 | 63% crude, 34% water, 3% kerosene diluent with 1570 ppm of a 20% solution from Example 1 (Compound #1)* | 64 | 29.0 | 24.5 | 39.0 |
| 4 | 63% crude, 34% water 3% kerosene diluent with 1570 ppm of a 20% solution from Example 1 (Compound #8)** | 64 | 19.0 | 36.0 | 49.5 |

*1570 ppm is based on total fluids (oil + water + kerosene)
**1570 ppm of the 20% active compound affords 314 ppm of surfactant

TABLE III

| | Oxyalkylated Nonyl Phenols | | | |
|---|---|---|---|---|
| COMPOUND NO. | MOLES OF NONYL PHENOL | MOLES OF PROPYLENE OXIDE | MOLES OF ETHYLENE OXIDE | MOLES OF PROPYLENE OXIDE |
| 27 | 1 | 7.6 | 40 | 0 |
| 28 | 1 | 3.8 | 40 | 0 |
| 29 | 1 | 0 | 40 | 0 |
| 30 | 1 | 7.6 | 70 | 0 |
| 31 | 1 | 0 | 70 | 0 |
| 32 | 1 | 0 | 50 | 1.9 |
| 33 | 1 | 1.9 | 50 | 0 |
| 34 | 1 | 3.8 | 50 | 0 |
| 35 | 1 | 7.6 | 60 | 0 |
| 36 | 1 | 7.6 | 20 | 0 |
| 37 | 1 | 7.6 | 10 | 0 |

Table IV compares kerosene solubilities of the selected surfactant solutions, prepared as described above, with each other and with surfactant alone added to kerosene. Note that no surfactant alone is soluble in the kerosene diluent to any appreciable extent. Use of the solvent system dramatically improves kerosene solubility and allows large quantities of surfactant to be solubilized in the kerosene. Note, also, that as more of the surfactant solution is added to the kerosene, it becomes more soluble in the kerosene. If more dilute mixtures of the surfactant solution in kerosene are made, some of the surfactant is dispersed, but not actually dissolved, in the kerosene. In addition, it can be seen that the modified surfactant structures containing propylene oxide are more kerosene soluble than surfactants with only ethylene oxide. For example, 7 weight % of the solution made from oxyalkylate #27 is totally kerosene soluble while 9 weight % of the solution made from oxyalkylate #29 (no propylene oxide) is needed for complete kerosene solubility. In other words a more dilute solution of #27 in kerosene may be injected into a viscous crude oil. (In this particular example the 7.6 moles of propylene oxide added before the 40 moles of ethylene oxide allows a 22% more dilute solution to still be completely kerosene soluble).

TABLE IV

Kerosene Solubility Comparison

| Oxyalkylate # from Table III prepared as a 20% solution in non-aqueous solvent (72% mixed alkyl phenol, 8% xylene) | Kerosene solubility (wt. %) of the 20% oxyalkylate solution at 24° C. | | | | | | |
|---|---|---|---|---|---|---|---|
| | 13% | 12% | 11% | 10% | 9% | 8% | 7% |
| 27 | | ** | | | | | * |
| 28 | | ** | | | | | * |
| 29 | | ** | | | | | * |
| 30 | | ** | | | | | * |
| 31 | | | | | | | |

*Dispersible
**Totally soluble

TABLE IV-A

| Oxyalkylate # from Table III without described nonaqueous solvent system | Kerosene solubility of oxyalkylate alone (wt. %) |
|---|---|
| 27 or 28 or 29 or 30 or 31 | Insoluble at any weight percent oxyalkylate in kerosene. Dispersible only at elevated temperatures, but upon cooling to 24° C., immediately comes out of solution. |

EXAMPLE 4

In order to more closely duplicate the actual field conditions, the black kerosene used as a diluent for the viscous crude oil produced in Santa Maria, Calif., was used as the test diluent. Oxyalkylated nonyl phenols were again prepared as 20% solutions (72% mixed alkyl phenols, 8% xylene). The 20% solution was then added to excess kerosene and allowed to sit for one to two hours to allow any insoluble compound to settle out (if any of the surfactant in fact did settle out, the viscosity reduction would be less). The amount of 20% compound solution added to the kerosene was chosen to give 1570 ppm of compound solution based on total volume of crude oil plus water plus kerosene used. (Since the compound solution was 20% oxyalkylate, the actual concentration of oxyalkylate used was 314 ppm).

After the compound solution in kerosene had settled, as described above, only the top layer of black kerosene was drawn off to give sufficient kerosene to provide 3% of the final mixture. The final mixture used in the viscosity comparisons in Table V contained 3% of the kerosene diluent (treated with the 20% oxyalkylate solution) plus 63% crude oil and 34% water. The data in Table V show that samples 4 and 5 (which have a greater number of moles of ethylene oxide on the nonyl phenol than samples 2 and 3) do not perform as well after the static period. In other words, the emulsion formed is less stable and breaks up too fast. Samples 2 and 3 are clearly superior and also indicate that the treatment chemical has remained soluble or dispersible in the black kerosene. Thus, a dramatic decrease in viscosity is seen using a nonaqueous diluent containing the described surfactants. Note also that by comparing sample 2 with sample 3 and sample 4 with sample 5, it can be seen that the new structure containing propylene oxide added before the ethylene oxide is clearly superior to the structure containing only ethylene oxide. Samples 3 and 5 (containing only ethylene oxide) are oxyethylated nonyl phenol as described in U.S. Pat. Nos. 3,380,531, 3,467,195 and 3,519,006 except that the described oxyalkylate has been introduced in a nonaqueous solvent. A number of the samples containing compounds of the present invention demonstrated better emulsion stability and viscosity reduction than previously described compounds.

TABLE V

| SAMPLE NO. | COMPOSITION | Viscosity Comparisons (Values in Centipoise) TEMP °C. | 60 RPM | 2 MIN DYNAMIC 60 RPM | 2 MIN WAIT Then 60 RPM |
|---|---|---|---|---|---|
| 1 | 63% crude, 34% water 3% kerosene distillate | 67 | 242 | 211 | 230 |
| 2 | 63% crude, 34% water, 3% kerosene distillate with 1570 ppm of the 20% solution of Compound #27 from Table III | 64 | 29.0 | 24.5 | 39.0 |
| 3 | 63% crude, 34% water, 3% kerosene distillate with 1570 ppm of the | 65.5 | 31.5 | 34.0 | 46.0 |

TABLE V-continued

| SAMPLE NO. | COMPOSITION | Viscosity Comparisons (Values in Centipoise) TEMP °C. | 60 RPM | 2 MIN DYNAMIC 60 RPM | 2 MIN WAIT Then 60 RPM |
|---|---|---|---|---|---|
| | 20% solution of Compound #29 from Table III | | | | |
| 4 | 63% crude, 34% water, 3% kerosene distillate with 1570 ppm of the 20% solution of Compound #30 from Table III | 64 | 40.0 | 62.5 | 190 |
| 5 | 63% crude, 34% water, 3% kerosene distillate with 1570 ppm of the 20% solution of Compound #31 from Table III | 64 | 39.5 | 104 | 205 |

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein, but rather that the claims be construed as encompassing all the features of patentable novelty which reside in the present invention, including all features which would be treated as equivalents thereof by those skilled in the art to which the invention pertains.

We claim:

1. In a method of enhancing the transportability through a pipeline of viscous hydrocarbons containing at least 10–15 percent water which comprises a step of adding a low viscosity hydrocarbon diluent to said viscous hydrocarbons to reduce the viscosity thereof, the improvement comprising adding to said diluent an effective oil-in-water emulsion-forming amount of a surfactant in at least one nonaqueous solvent therefor, adding the surfactant/solvent/diluent to said viscous hydrocarbons in the absence of added water, forming an oil-in-water emulsion of said viscous hydrocarbons and said water in said pipeline and transporting said emulsion through said pipeline.

2. Method of claim 1 wherein said diluent is a light oil.

3. Method of claim 2 wherein said light oil is kerosene.

4. Method of claim 2 wherein said light oil is condensate.

5. Method of claim 1 wherein said solvent is highly soluble in said diluent and compatible with said surfactant.

6. Method of claim 5 wherein said solvent is an aromatic solvent.

7. Method of claim 6 wherein said solvent is an alkyl phenol.

8. Method of claim 6 wherein said solvent is a xylene.

9. Method of claim 5 wherein said solvent is a mixture of solvents.

10. Method of claim 1 wherein said surfactant is anionic.

11. Method of claim 10 wherein said surfactant is a sulfated oxyalkylated fatty alcohol.

12. Method of claim 10 wherein said surfactant is a sulfated oxyalkylated phenol.

13. Method of claim 10 wherein said surfactant is an alkarylsulfonate.

14. Method of claim 1 wherein said surfactant is cationic.

15. Method of claim 14 wherein said surfactant is selected from the group consisting of an oxyalkylated amine and quaternaries thereof.

16. Method of claim 14 wherein said surfactant is selected from the group consisting of an oxyalkylated polyamine and quaternaries thereof.

17. Method of claim 14 wherein said surfactant is selected from the group consisting of an oxyalkylated alkanolamine and quaternaries thereof.

18. Method of claim 1 wherein said surfactant is nonionic.

19. Method of claim 18 wherein said surfactant is represented by the formulas:

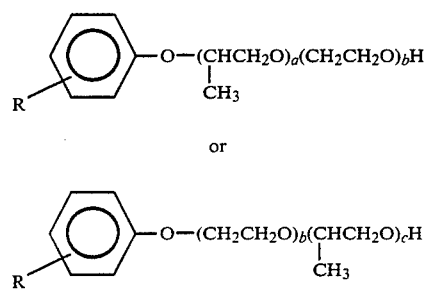

wherein

R represents an alkyl group of from about 3 to about 24 carbon atoms;

a represents a number of from 1 to about 40;

b represents a number of from about 10 to about 100;

c represents a number of from about 1 to about 20.

20. Method of enhancing the transportability through a pipeline of viscous hydrocarbons containing at least 10–15 percent water comprising adding thereto in the absence of added water an effective oil-in-water emulsion-forming amount of surfactant in a nonaqueous solvent therefor, said nonaqueous solvent comprising at least one alkyl phenol, forming an oil-in-water emulsion of said viscous hydrocarbons and said water in said pipeline and transporting said emulsion through said pipeline.

21. Method of claim 20 wherein said solvent is an aromatic solvent.

22. Method of claim 20 wherein said solvent is a mixture of said alkyl phenol and xylene.

23. Method of claim 20 wherein said surfactant is anionic.

24. Method of claim 23 wherein said surfactant is a sulfated oxyalkylated fatty alcohol.

25. Method of claim 23 wherein said surfactant is a sulfated oxyalkylated phenol.

26. Method of claim 23 wherein said surfactant is an alkarylsulfonate.

27. Method of claim 20 wherein said surfactant is cationic.

28. Method of claim 27 wherein said surfactant is selected from the group consisting of an oxyalkylated amine and quaternaries thereof.

29. Method of claim 27 wherein said surfactant is selected from the group consisting of an oxyalkylated polyamine and quaternaries thereof.

30. Method of claim 27 wherein said surfactant is selected from the group consisting of an oxyalkylated alkanolamine and quaternaries thereof.

31. Method of claim 20 wherein said surfactant is nonionic.

32. Method of claim 31 wherein said surfactant is represented by the formulas:

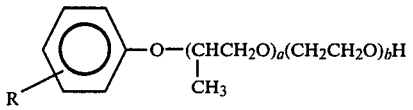

or

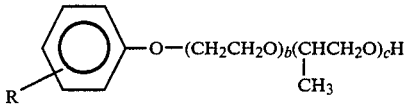

wherein

R represents an alkyl group of from about 3 to about 24 carbon atoms;

a represents a number of from 1 to about 40;

b represents a number of from about 10 to about 100;

c represents a number of from about 1 to about 20.

* * * * *